US008910623B2

(12) United States Patent
Husted

(10) Patent No.: US 8,910,623 B2
(45) Date of Patent: Dec. 16, 2014

(54) REFRACTORY PANELS WITH GROUT-CAPTURING CHANNELS

(75) Inventor: Martin D. Husted, Glendora, CA (US)

(73) Assignee: FMI Acquisition, LLC, Santa Ana, CA (US)

( * ) Notice: Subject to any disclaimer, the term of this patent is extended or adjusted under 35 U.S.C. 154(b) by 752 days.

(21) Appl. No.: 12/048,174

(22) Filed: Mar. 13, 2008

(65) Prior Publication Data

US 2008/0236566 A1 Oct. 2, 2008

Related U.S. Application Data

(60) Provisional application No. 60/894,598, filed on Mar. 13, 2007.

(51) Int. Cl.
*F24B 1/18* (2006.01)
*F23M 5/00* (2006.01)
*E04F 19/00* (2006.01)

(52) U.S. Cl.
CPC ..... *F23M 5/00* (2013.01); *F23M 2900/05004* (2013.01); *E04F 19/00* (2013.01)
USPC ..... 126/500

(58) Field of Classification Search
USPC ..... 126/500, 512, 144; 428/141, 139, 140, 428/161; 52/316, 596, 314, 437, 438; 40/428; 249/16; 392/348
See application file for complete search history.

(56) References Cited

U.S. PATENT DOCUMENTS

| | | | | | |
|---|---|---|---|---|---|
| 2,938,376 | A * | 5/1960 | Workman et al. | 52/426 |
| 3,210,231 | A * | 10/1965 | Abernethy | 156/518 |
| 4,313,775 | A * | 2/1982 | Moore | 156/196 |
| 4,619,093 | A * | 10/1986 | Gandillon | 52/311.2 |
| 5,228,937 | A * | 7/1993 | Passeno | 156/299 |
| 5,311,714 | A * | 5/1994 | Passeno | 52/314 |
| 5,901,701 | A * | 5/1999 | Wade | 126/512 |
| 6,029,654 | A * | 2/2000 | Wade | 126/512 |
| 6,164,037 | A * | 12/2000 | Passeno | 52/749.11 |
| 7,121,051 | B2 * | 10/2006 | Hunsaker | 52/314 |
| 2008/0216818 | A1 * | 9/2008 | Rumens et al. | 126/500 |

FOREIGN PATENT DOCUMENTS

WO WO 2004057131 A1 * 7/2004

OTHER PUBLICATIONS

Canadian Office Action dated Jun. 27, 2014, Received Jul. 7, 2014, regarding Canadian Patent Application No. 2625510.

* cited by examiner

*Primary Examiner* — Thomas Denion
*Assistant Examiner* — Daniel Bernstein
(74) *Attorney, Agent, or Firm* — Arent Fox LLP

(57) ABSTRACT

A refractory panel is formed with recesses delineating a pair of adjoining brick relief patterns. One or more depressions are formed in the recesses such that grout or the like placed in the recesses form fingers that harden into position.

68 Claims, 3 Drawing Sheets

REFRACTORY PANELS WITH GROUT-CAPTURING CHANNELS

CROSS-REFERENCE TO RELATED APPLICATION

The present application for patent claims priority under 35 U.S.C. §119 to Provisional Application No. 60/894,598 entitled, "Refractory With Grout-Capturing Channels," filed Mar. 13, 2007.

BACKGROUND

1. Field

The present disclosure generally relates to factory engineered hearth products. More particularly, the present disclosure relates to refractory panels designed to provide a masonry appearance.

2. Background

Factory engineered hearth products have over the years used the technique of molded refractory panels to simulate a real masonry appearance, such as the panel shown in FIG. 1. In the configuration shown in FIG. 1, a brick pattern 1 is arranged in a running bond configuration. Panels also have been made in a herringbone, split running bond, or split herringbone pattern. Thus, these panels attempt to emulate the appearance of traditional masonry products.

Brick pattern panels are generally formed by molding techniques. Once molded, the panels feature the appearance of several courses of bricks 1 separated by recessed areas 3, as shown in FIG. 2. In an attempt to represent more of a true masonry look, the panels can be painted. The painting techniques have allowed either darker or lighter color paint to settle in lower areas to add to the effect of true bricks. The paint also settles in the recessed areas 3 and provides a colored recessed area 3.

It has been attempted to fill the recessed areas 3 between the simulated bricks 1 of the brick pattern, as shown in FIG. 3. For instance, a mortar material 6 can be deposited in the recessed area 3. The attempt to fill the recessed areas 3 with grout material 6 has resulted in many field problems. For instance, the panels undergo significant thermal cycling during firing and cooling of the appliance. The thermal cycling usually results in the separation of grout material. The separated grout material then falls off within a short amount of operating time. In addition, grout material may separate from the panel during transport due to the vibrations experienced in over-the-road transportation. Because of these field problems, the filling of recessed areas 3 of the refractory panels with grout material 6 largely has been abandoned.

SUMMARY OF THE INVENTION

In one aspect of the disclosure, a refractory panel includes first and second raised portions separated by a recess comprising one or more depressions, the recess being configured to receive a material that is capable of working into the one or more depressions prior to hardening.

In another aspect of the disclosure, a refractory panel includes first and second raised portions separated by a recess configured to receive a material, wherein the recess undercuts the refractory panel.

In yet another aspect of the disclosure, a refractory panel includes first and second raised portions separated by a recess configured to receive a material, and means for rendering the material captive to the refractory panel.

In a further aspect of the disclosure, an apparatus includes a firebox having a plurality of walls, wherein at least one of the walls includes a refractory panel comprising first and second raised portions separated by a recess comprising one or more depressions and a material disposed in the recess, the material having worked into the one or more depressions prior to hardening.

In yet a further aspect of the disclosure, a method of manufacturing a refractory panel having first and second raised portions separated by a recess includes forming the recess with one or more depressions, the recess being configured to receive a material that is capable of working into the one or more depressions prior to hardening.

It is understood that other aspects of the invention will become readily apparent to those skilled in the art from the following detailed description, wherein it is shown and described only various aspects of the invention by way of illustration. As will be realized, the invention is capable of other and different configurations and its several details are capable of modification in various other respects, all without departing from the scope of the invention. Accordingly, the drawings and detailed description are to be regarded as illustrative in nature and not as restrictive.

BRIEF DESCRIPTION OF THE DRAWINGS

The drawings disclose illustrative embodiments. They do not set forth all embodiments. Other embodiments may be used in addition or instead. Details that may be apparent or unnecessary may be omitted for more effective illustration. When the same numeral appears in different drawings, it is intended to refer to the same or like components or steps.

DETAILED DESCRIPTION

The detailed description set forth below in connection with the appended drawings is intended as a description of various configurations of the present invention and is not intended to represent the only configurations in which the present invention may be practiced. The detailed description includes specific details for the purpose of providing a thorough understanding of the present invention. However, it will be apparent to those skilled in the art that the present invention may be practiced without these specific details. In some instances, well-known structures and components are shown in block diagram form in order to avoid obscuring the concepts of the present invention.

In the following detailed description, various concepts will be described in the context of a refractory panel that simulates the look of a brick pattern for a fireplace. While these concepts are well suited for this application, those skilled in the art will readily appreciate that the refractory panel may also be used for other hearth products, including by way of example, and without limitation, stoves, heaters, furnaces, outdoor fire products, water heating products, barbeque and grilling products, and the like. Moreover, these concepts may be extended to other refractory panels that simulate the look of a stone pattern, a tile pattern, or any other suitable pattern. Accordingly, any reference to a refractory panel that simulates the look of a brick pattern for a fireplace is intended only to illustrate these concepts, with the understanding the such concepts have a wide range of applications.

Figure 1:
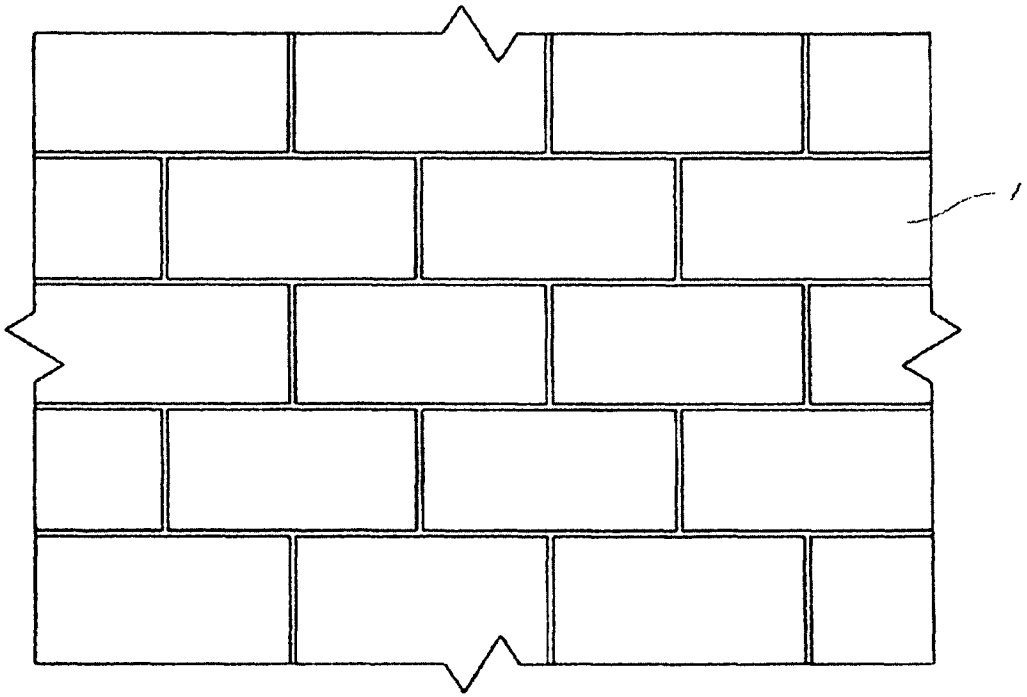
FIG. 1 illustrates in elevation view a refractory panel comprising multiple courses of simulated bricks separated by recesses.
Figure 2:
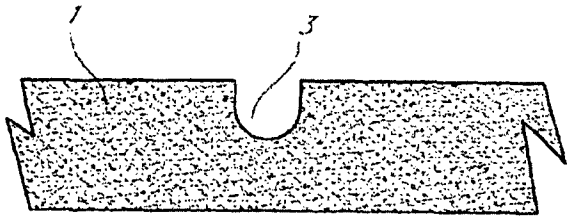
FIG. 2 (PRIOR ART)
FIG. 2 illustrates in cross section a portion of a refractory panel that includes two simulated bricks separated by a recess.
Figure 3:
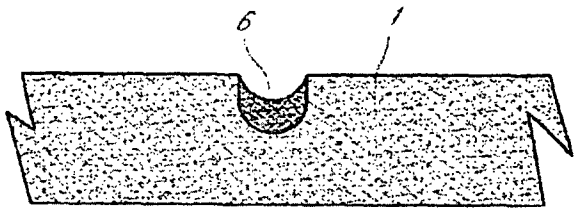
FIG. 3 (PRIOR ART)
FIG. 3 illustrates in cross section a portion of a refractory panel that includes two simulated bricks separated by a recess with the recess containing grouting or other material.
Figure 4:
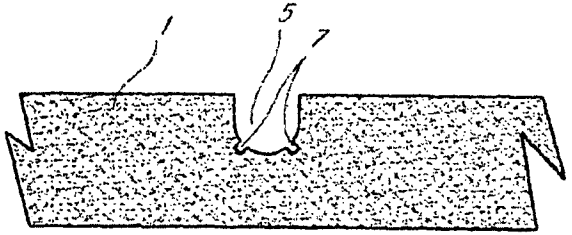
FIG. 4 illustrates in cross section a portion of a refractory panel that includes two simulated bricks separated by a recess comprising two depressions.
Figure 5:
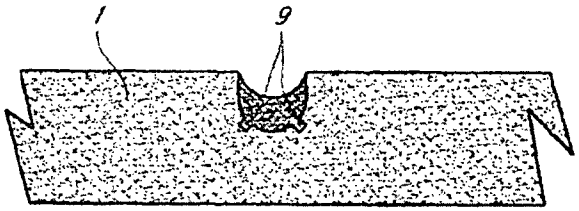
FIG. 5 illustrates in cross section a portion of a refractory panel that includes two simulated bricks separated by a recess comprising two depressions containing grouting or other material.

With reference to FIGS. 4 and 5, a portion of a refractory panel, such as that shown in FIG. 1, is illustrated. The portion shown comprises two raised portions simulating two bricks 1 separated by a recess 5. The panel can comprise any number of simulated bricks 1 with one or more of the simulated bricks 1 separated by recesses 5.

Figure 7:
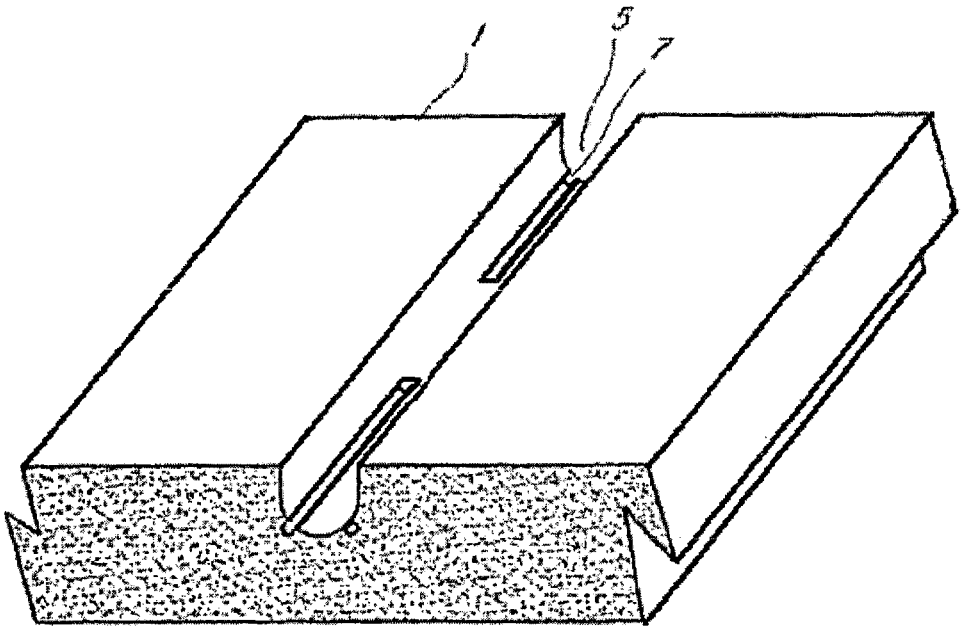
FIG. 7 is a perspective view of a portion of a refractory panel that includes two simulated bricks separated by a recess comprising two depressions having a length shorter than a length of the recess.

As shown in FIGS. 4, 5, and 7, the recess 5 between the simulated bricks 1 can include one or more depressions 7. The depressions 7 are configured to undercut the refractory panel. The depressions 7 can have any suitable shape. In the illustrated configuration, two depressions 7 are used. More or less depressions can be used, depending upon the application. The depressions 7 in the illustrated configuration extend generally away from each other. Other configurations also can be used. The illustrated depressions 7 are short slots. These slots have a generally U-shaped configuration. In other configurations, the slots could be V-shaped or the like. In addition, the depressions 7 need not be slots but can have other suitable configurations. Furthermore, the slots can extend the length (i.e., the direction in and out of the paper) of the recess 5 or can have shorter lengths such the each recess 5 contains multiple spaced depressions 7, as illustrated in FIG. 7. The slots do not need to be the entire length of the refractory grout line, but may be. It may be more desirable to make the slots from ¼ inch to one inch long and to locate two to three per length of brick and one to two per width of brick. These numbers may change with the usage on herringbone or split brick designs. Of course, other lengths and spacing can be used as desired.

As shown in FIG. 5, when a material, such as grout or other material that simulates grout, is placed in the recess 5, the material works into the depressions 7. Once sufficient solidified, the material can be locked into the recessed area 5 through the fingers 9 that are defined within the depressions 7. In other words, the solidified material includes integrally formed fingers 9 that lock the material in position relative to the simulated bricks 1.

Figure 6:
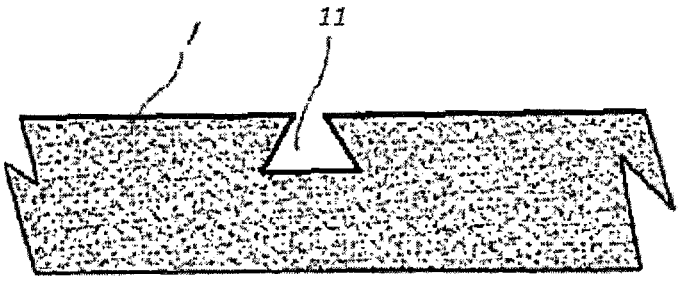
FIG. 6 illustrates in cross section a portion of a refractory panel that includes two simulated bricks separated by a recess having an inverted V-shape.

As described above, depressions 7 formed in the recess 5 are used to undercut the refractory panel. However, as those skilled in the art will readily appreciate, other techniques may be used to undercut the refractory panel. By way of example, and without limitation, as illustrated in FIG. 6, the recess 11 can be formed with an inverted V-shape to undercut the refractory panel.

The refractory panel can be formed in any suitable technique. In one configuration, the refractory panel is molded using rubber molds. Other techniques also can be used. With the use of a softer rubber mold to produce the refractory panel it is possible to form one or more small protrusion, which are used to form the depressions 7, and still remove the mold from the hardened refractory. The depressions 7 that undercut the refractory panel may be formed such that they do not undercut the simulated bricks 1 to facilitate removal of the rubber mold. While most refractory panels are poured into a hard plastic mold, using a hard plastic mold greatly reduces, if not eliminates, the ability to have a negative draft within the molding process. In a preferred configuration, a negative draft is used to form the depressions 7.

Following molding, the refractory panel may be painted in any suitable manner. In some configurations, the refractory panel is dipped into the paint but other configurations also can be used. Painting allows the refractory panels to more closely simulate actual masonry products. The material is poured into the recess 5 in the refractory panel, and with the filling of the depressions 7, when the material dries it becomes captive to the refractory panel.

The previous description of the disclosed embodiments is provided to enable any person skilled in the art to make or use the present invention. Various modifications to these embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular is not intended to mean "one and only one" unless specifically so stated, but rather "one or more." All structural and functional equivalents to the elements of the various embodiments described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. §112, sixth paragraph, unless the element is expressly recited using the phrase "means for" or, in the case of a method claim, the element is recited using the phrase "step for."

What is claimed is:

1. A refractory panel, comprising:

a refractory panel formed of a refractory composition, where the refractory composition comprises:

first and second raised portions;

a recess defined by the refectory composition separating the first and second raised portions, the recess having a first length, and the recess extending part way through the refractory composition, and one or more depressions having a second length, the one or more depressions extending from the recess into the refractory composition, the recess being configured to receive a material that is capable of working into the one or more depressions prior to hardening, wherein the second length is shorter than the first length.

2. The refractory panel of claim 1 wherein the first and second raised portions are configured to simulate the look of two bricks.

3. The refractory panel of claim 1 wherein the first and second raised portions are configured to simulate the look of two stones.

4. The refractory panel of claim 1 wherein the first and second raised portions are configured to simulate the look of two tiles.

5. The refractory panel of claim 1 further comprising the material in the recess.

6. The refractory panel of claim 5 wherein the material comprises grout.

7. The refractory panel of claim 5 wherein the material comprises a material that simulates the look of grout.

8. The refractory panel of claim 5 wherein the material comprises one or more fingers that lock the material in the recess.

9. The refractory panel of claim 5 wherein the material comprises one or more fingers, each of the one or more fingers extending into a corresponding one of the one or more depressions.

10. The refractory panel of claim 5 wherein the material comprises a shape formed by the recess and the one or more depressions.

11. The refractory panel of claim 5 wherein the material extends into the one or more depressions to render to material captive to the refractory composition.

12. The refractory panel of claim 1 wherein the one or more depressions comprises two depressions.

13. The refractory panel of claim 12 wherein the two depressions extend away from each other.

14. A refractory panel, comprising:

a refractory panel formed of a refractory composition, where the refractory composition comprises first and second raised portions;

a recess defined by the refectory composition separating the first and second raised portions of the refractory composition, the recess extending part way through the refractory composition; and one or more depressions extending from the recess into the refractory composition, the recess being configured to receive a material that is capable of working into the one or more depressions prior to hardening, wherein the one or more depressions undercut the refractory composition without undercutting the first and second raised portions.

15. The refractory panel of claim 1 wherein at least one of the one or more depressions comprises a slot.

16. The refractory panel of claim 15 wherein the slot comprises a U-shaped configuration.

17. The refractory panel of claim 1 wherein at least one of the one or more depressions extend the length of the recess.

18. A refractory panel, comprising:

a refractory panel formed of a refractory composition, where the refractory composition comprises first and second raised portions;

a recess defined by the refectory composition, the recess separating the first and second raised portions, and the recess extending part way through the refractory composition; and one or more depressions extending from the recess into the refractory material, the recess being configured to receive a material that is capable of working into the one or more depressions prior to hardening wherein the one or more depressions comprises a plurality of spaced apart depressions extending along at least a portion of the length of the recess.

19. A refractory panel, comprising:

a refractory panel formed of a refractory composition, where the refractory composition comprises first and second raised portions;

a recess defined by the refectory composition separating the first and second raised portions, the recess having a first length, the recess extending part way through the refractory composition, and the recess configured to receive a material, a portion of the recess having a second length, wherein the portion of the recess undercuts the refractory composition, and wherein the second length is shorter than the first length.

20. The refractory panel of claim 19 wherein the first and second raised portions are configured to simulate the look of two bricks.

21. The refractory panel of claim 19 wherein the first and second raised portions are configured to simulate the look of two stones.

22. The refractory panel of claim 19 wherein the first and second raised portions are configured to simulate the look of two tiles.

23. The refractory panel of claim 19 further comprising the material in the recess.

24. The refractory panel of claim 23 wherein the material comprises grout.

25. The refractory panel of claim 23 wherein the material comprises a material that simulates the look of grout.

26. The refractory panel of claim 19 wherein the recess comprises an inverted V-shaped configuration which undercuts the refractory composition.

27. The refractory panel of claim 19 wherein the portion of the recess that undercuts the refractory composition comprises one or more depressions.

28. The refractory panel of claim 27 further comprising the material in the recess, wherein the material comprises one or more fingers that lock the material in the recess.

29. The refractory panel of claim 27 further comprising the material in the recess, wherein the material comprises one or more fingers, each of the one or more fingers extending into a corresponding one of the one or more depressions.

30. The refractory panel of claim 27 further comprising the material in the recess, wherein the material comprises a shape formed by the recess and the one or more depressions.

31. The refractory panel of claim 27 further comprising material, wherein the material extends into the one or more depressions to render the material captive to the refractory composition.

32. The refractory panel of claim 27 wherein the one or more depressions comprises two depressions.

33. The refractory panel of claim 32 wherein the two depressions extend away from each other.

34. The refractory panel of claim 27 wherein at least one of the one or more depressions comprises a slot.

35. The refractory panel of claim 34 wherein the slot comprises a U-shaped configuration.

36. The refractory panel of claim 27 wherein at least one of the one or more depressions extend the length of the recess.

37. A refractory panel, comprising:

a refractory panel formed of a refractory composition, where the refractory composition comprises first and second raised portions;

a recess defined by the refectory composition separating the first and second raised portions, the recess extending part way through the refractory composition, the recess configured to receive a material, wherein a portion of the recess undercuts the refractory composition without undercutting the first and second raised portions.

38. A refractory panel, comprising:

a refractory panel formed of a refractory composition, where the refractory composition comprises first and second raised portions;

a recess defined by the refectory composition separating the first and second raised portions, the recess extending part way through the refractory composition, and the recess configured to receive a material, wherein a portion of the recess undercuts the refractory composition, wherein the portion of the recess that undercuts the refractory composition comprises one or more depressions extending from the recess into the refractory composition, and wherein the one or more depressions comprises a plurality of spaced apart depressions extending along at least a portion of the length of the recess.

39. A refractory panel, comprising:

a refractory panel formed of a refractory composition, the refractory composition comprising first and second raised portions;

a recess defined by the refectory composition separating the first and second raised portions, the recess having a first length, the recess extending part way through the refractory composition, the recess configured to receive a material; and one or more depressions extending into the refractory composition the recess being configured to receive a material that is capable of working into the one or more depressions prior to hardening and wherein at least one of the one or more depressions comprises a length shorter than the length of the recess.

40. The refractory panel of claim 39 wherein the first and second raised portions are configured to simulate the look of two bricks.

41. The refractory panel of claim 39 wherein the first and second raised portions are configured to simulate the look of two stones.

42. The refractory panel of claim 39 wherein the first and second raised portions are configured to simulate the look of two tiles.

43. The refractory panel of claim 39 further comprising the material in the recess.

44. The refractory panel of claim 43 wherein the material comprises grout.

45. The refractory panel of claim 43 wherein the material comprises a material that simulates the look of grout.

46. An apparatus, comprising:

a firebox having a plurality of walls, wherein at least one of the walls includes a refractory panel formed of a refractory composition, where the refractory composition comprises first and second raised portions;

a recess defined by the refectory composition separating the first and second raised portions, the recess having a first length, and the recess extending part way through in the refractory composition, one or more depressions having a second length, the one or more depressions extending from the recess into the refractory material and a material disposed in the recess, the material having worked into the one or more depressions prior to hardening, wherein the second length is shorter than the first length of the recess.

47. The apparatus of claim 46 further comprising a burner in the firebox.

48. The apparatus of claim 46 wherein the first and second raised portions are configured to simulate the look of two bricks.

49. The apparatus of claim 46 wherein the first and second raised portions are configured to simulate the look of two stones.

50. The apparatus of claim 46 wherein the first and second raised portions are configured to simulate the look of two tiles.

51. The apparatus of claim 46 wherein the material comprises grout.

52. The apparatus of claim 46 wherein the material comprises a material that simulates the look of grout.

53. The apparatus of claim 46 wherein the material comprises one or more fingers that lock the material in the recess.

54. The apparatus of claim 46 wherein the material comprises one or more fingers, each of the one or more fingers extending into a corresponding one of the one or more depressions.

55. The apparatus of claim 46 wherein the material comprises a shape formed by the recess and the one or more depressions.

56. The apparatus of claim 46 wherein the material extends into the one or more depressions to render to material captive to the refractory composition.

57. A method of manufacturing a refractory panel formed of a refractory composition, comprising:

forming a recess defined by the refectory composition separating first and second raised portions, the recess extending part way through the refractory composition, the recess with one or more depressions extending into the refractory composition, the one or more depressions comprising a length shorter than the length of the recess, the recess being configured to receive a material that is capable of working into the one or more depressions prior to hardening.

58. The method of claim 57 further comprising forming the first and second raised portions to simulate the look of two bricks.

59. The method of claim 57 further comprising forming the first and second raised portions to simulate the look of two stones.

60. The method of claim 57 further comprising forming the first and second raised portions to simulate the look of two tiles.

61. The method of claim 57 further comprising depositing the material in the recess.

62. The method of claim 61 wherein the material comprises grout.

63. The method of claim 61 wherein the material comprises a material that simulates the look of grout.

64. The method of claim 61 wherein the depositing of the material in the recess comprises forming one or more fingers that lock the material in the recess.

65. The method of claim 61 wherein the depositing of the material in the recess comprises forming one or more fingers, each of the one or more fingers extending into a corresponding one of the one or more depressions.

66. The method of claim 61 wherein the depositing of the material in the recess comprises forming the material into a shape defined by the recess and the one or more depressions.

67. The method of claim 61 wherein the depositing of the material in the recess comprises extending the material into the one or more depressions to render to material captive to the refractory composition.

68. The method of claim 57 wherein the one or more depressions comprises two depressions.

* * * * *